United States Patent [19]

Johnson

[11] 4,088,334

[45] May 9, 1978

[54] SKATEBOARD BRAKE

[76] Inventor: Elmer E. Johnson, 622 Locust Rd., Sausalito, Calif. 94965

[21] Appl. No.: 781,111

[22] Filed: Mar. 25, 1977

[51] Int. Cl.[2] ..... A63C 17/14

[52] U.S. Cl. ..... 280/11.2; 188/2 R; 188/29; 280/87.04 A

[58] Field of Search ..... 280/11.2, 87.04 A, 87.04 R; 188/2 R, 29, 5

[56] References Cited

U.S. PATENT DOCUMENTS

| | | | |
|---|---|---|---|
| 939,536 | 11/1909 | Nesbitt, Sr. | 280/11.2 |
| 1,050,490 | 1/1913 | Schwarz | 280/11.2 |
| 1,138,263 | 5/1915 | Tutt | 280/87.04 R |
| 1,530,165 | 3/1925 | Fowler | 280/87.04 A |
| 2,051,762 | 8/1936 | Vincent | 280/87.04 R |
| 2,200,935 | 5/1940 | Rodriguez | 188/5 |
| 3,339,936 | 9/1967 | Hamlin | 280/11.2 |

*Primary Examiner*—Robert R. Song
*Assistant Examiner*—Milton L. Smith
*Attorney, Agent, or Firm*—Gordon Wood

[57] ABSTRACT

A brake is provided which is completely separate from the ground wheels of the skateboard. A ground engaging brake wheel is swingably supported relative to the skateboard so that it may be swung into rolling engagement with the ground and with the braking surface. The brake may be cantilevered from the rear end of the skateboard or may be positioned centrally of the skateboard between the two pairs of ground wheels.

9 Claims, 6 Drawing Figures

SKATEBOARD BRAKE

In the art of roller skates and skateboards numerous types of brakes have been proposed in which the braking is effected on the normal ground wheels of the skate or skateboard in a manner similar to the manner in which most vehicles are braked. In the case of a skateboard such prior art structures cooperating with the ground wheels of the skateboard result in complications in design and in some instances introduce a hazard that the brake may be applied unintentionally.

In Schwartz U.S. Pat. No. 1,050,490 an attempt was made to provide a separate braking means for roller skates and which means required no cooperation with the normal ground wheels. However, the structure provided is quite complicated and expensive to produce.

The main object of the present invention is the provision of a brake for a skateboard which is entirely separate from the ground wheels of the skateboard and which may be applied by the user in an effective manner and at the same time minimize any likelihood of accidental application of the brake.

Another object of the invention is the provision of a simple skateboard brake which may readily be applied to existing skateboards to provide an effective braking means.

Other objects and advantages will be apparent from the following specification and from the drawings.

Figure 1:
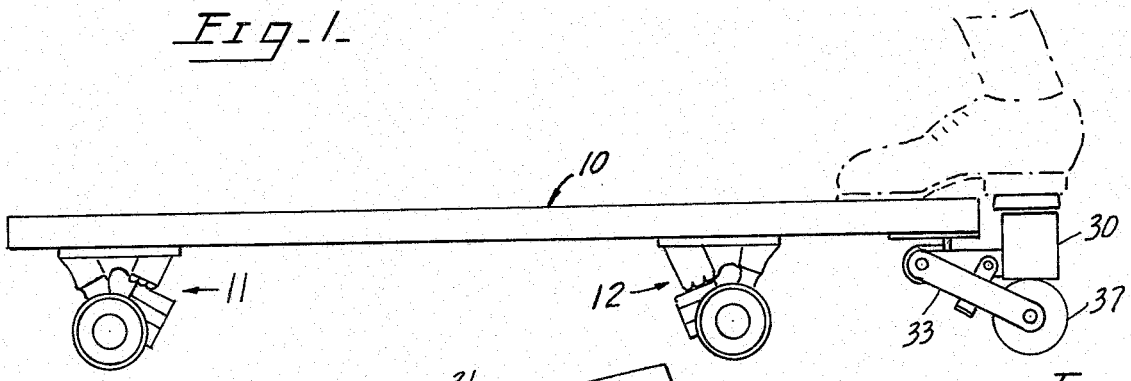
FIG. 1 is a reduced side elevational view of a skateboard showing one form of the invention applied thereto.

With reference to FIG. 1 a conventional skateboard generally designated 10 is provided with a front truck 11 and a rear truck 12. Secured to the underside of the skateboard at its rear end as by screws 15 and nuts 16 is a mounting plate 17. Fixedly secured to the mounting plate 17 is a bracket 18 which includes a depending flange 19 to which is secured a yoke 21 by means of a bolt 22 and nut 23. At this point it will be noted that the bolt 22 provides a pivot permitting the yoke 21 to swing to a limited degree about a horizontal longitudinally extending axis.

Passed through the legs of yoke 21 is an elongated bolt 25 which supports a lever structure which will now be described. A pair of elongated inner links 27, 28 are swingably supported at one of their corresponding ends on bolt 25 and are secured at their opposite ends to a housing generally designated 30 which in turn supports a foot operated pedal 31 (FIGS. 2, 3).

Also swingable on bolt 25 are a pair of outer links 33, 34 which carry at their opposite ends a bolt 36 which rotatably supports a ground engaging wheel 37. Bolts 25, 36 are provided with nuts 39, 40 respectively as indicated in FIG. 4.

Figure 4:
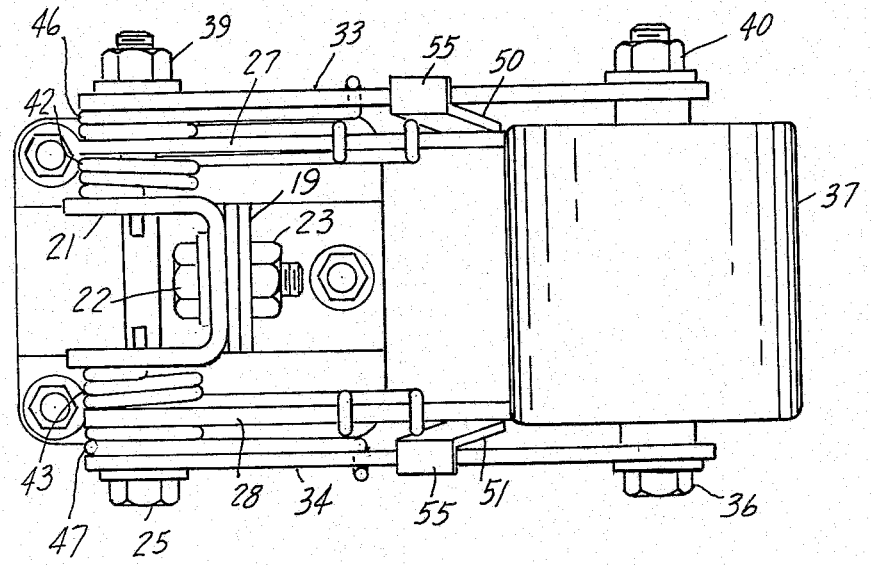
FIG. 4 is a bottom plan view of the brake of FIG. 2.

The inner links 27, 28 are spring urged upwardly at all times by means of a pair of torsion springs 42, 43 as best seen in FIG. 4 and the outer links 33, 34 are spring urged away from links 27, 28 by means of torsion springs 46, 47.

Figure 2:
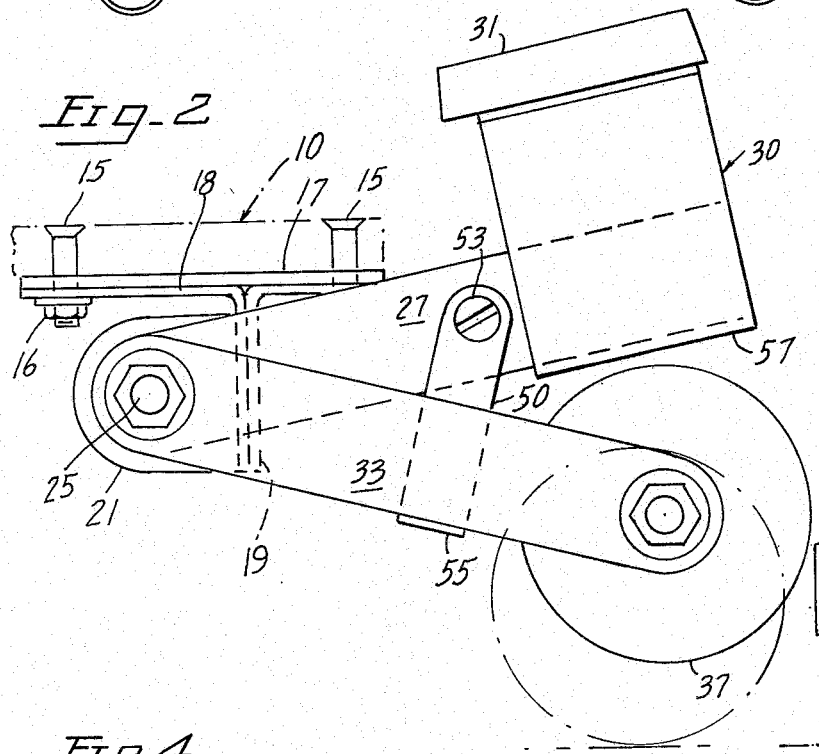
FIG. 2 is an enlarged side elevation of the brake of FIG. 1 showing the brake in its retracted position.
Figure 3:
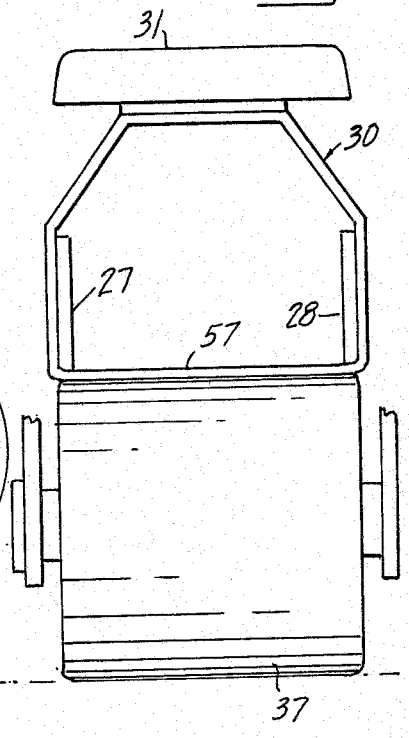
FIG. 3 is an end elevation of the structure of FIG. 2 showing the brake in applied position.

From the above described structure it will be apparent that the brake assembly is normally urged upwardly to the position shown in FIG. 2. In order to limit the movement of links 33, 34 away from links 27, 28 a pair of flat bar stops 50, 51 are secured at one of their ends to links 27, 28 by screws 53 and are formed at their opposite ends with flanges 55 to engage the lower side edges of links 33, 34.

The housing 30 has a lower side 57 which provides a braking surface against which the periphery of wheel 37 may engage.

In operation, when the user wishes to engage the brake, he steps downwardly on the pedal 31 (FIG. 1) causing two movements of the above described structure as follows: first, the entire structure is swung downwardly until ground wheel 37 engages the ground and upon further movement the braking surface 57 is brought into engagement with the upper side of wheel 37 against the urgency of torsion springs 46, 47. This action is desirable in that the ground wheel 37 starts to rotate before being engaged by the braking surface 57. In this way a more accurate amount of braking effort is possible on the part of the user and the possibility of flat spots being worn on the brake wheel is minimized.

Referring again to FIG. 4 it will be noted that by mounting the structure disclosed through a yoke 21 and pivotally supporting it as by bolt 22 it is possible for the brake structure to swing about a horizontal longitudinally extending axis so as to permit the ground engaging brake wheel to track the road at all times.

Figure 5:
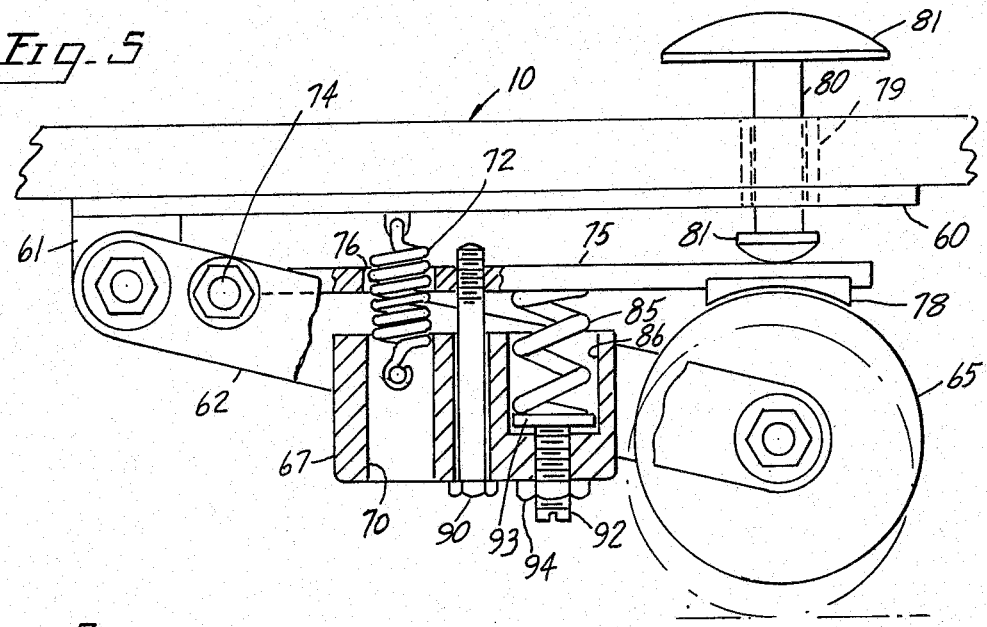
FIG. 5 is a side elevation of the central portion of a skateboard showing a modified form of brake.
Figure 6:
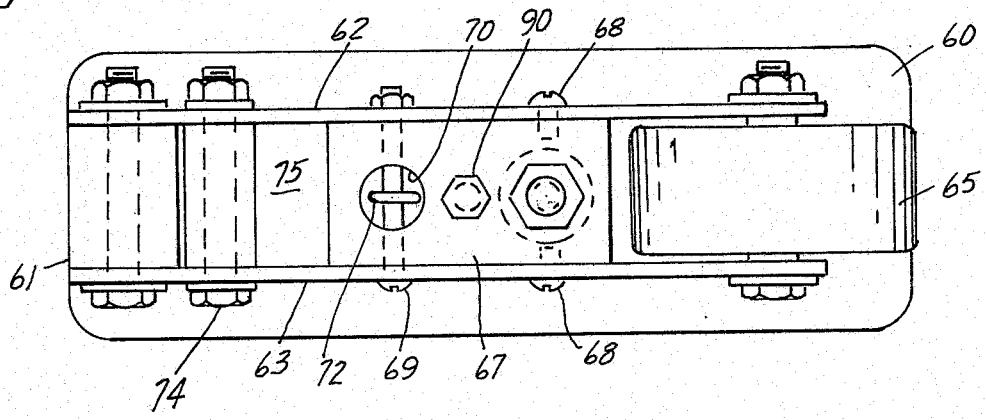
FIG. 6 is a bottom plan view of the structure of FIG. 5.

Another form of the invention is shown in FIGS. 5, 6 wherein a brake is provided on the central portion of the skateboard between the trucks 11, 12. In this case a mounting plate 60 is secured to the underside of the skateboard 10. Fixedly mounted on the forward end of mounting plate 60 is a bearing 61 which serves to swingably support a pair of links 62, 63 which rotatably support at their opposite ends the brake wheel 65.

Interposed between the links 62, 63 is a block 67 which is secured to links 62, 63 by screws 68 and a bolt 69. Bolt 69 passes through a vertically extending bore 70 in block 67 which is adapted to receive therein the lower end of a tension spring 72 which is connected at said lower end to the shank of bolt 69 and connected at its upper end to the underside of mounting plate 60. This tension spring 72 has the effect of raising the lever supported brake wheel 65 to an upper position such as shown in FIG. 5.

Swingably supported on links 62, 63 by means of bolt 74 is a generally horizontally disposed arm 75 which is formed with an aperture 76 for receiving tension spring 72 therethrough. This arm 75 is provided at its free end with a brake shoe 78 which is adapted to engage the periphery of brake wheel 65.

Skateboard 10 is drilled to receive a sleeve 79 therethrough which slideably supports a rod 80 provided at its lower end with a head 81 in engagement with the upper side of arm 75. The upper end of rod 80 is provided with a pedal 81 to permit the user to press downwardly on the same to urge arm 75 downwardly to activate the brake.

Interposed between the block 67 and the underside of arm 75 is a compression spring 85 which is received in an upwardly opening bore 86 in said block 67. The upper end of spring 85 bears against the underside of arm 75 to thereby urge the brake shoe 78 and the wheel 65 away from each other at all times.

The gap between the brake shoe 78 and the periphery of wheel 65 is adjustable by means of an adjusting screw 90 which is loosely received through a vertically extending hole in block 67 and into threaded engagement with the arm 75.

The compression spring 85 permits an adjustment for the weight of the rider so that the force exerted by spring 85 may be increased for a heavy rider and decreased for a lighter rider. This adjustment is achieved by means of a screw 92 which is threadedly received within block 67 and which is provided at its inner end with a foot 93 against which the compression spring 85 bears. A check nut 94 may be provided for holding the screw 92 in adjusted position.

I claim:

1. In a skateboard having an elongated body and ground wheels, a brake for said skateboard comprising:

a first lever swingably secured to said body and provided with a braking surface, a second lever swingable relative to said first lever, a ground engaging brake wheel separate from said ground wheels and rotatably mounted on said second lever, spring means urging said first lever upwardly, and means interposed between said levers for holding said brake wheel out of engagement with the ground whereby when the first lever is urged downwardly against the urgency of said spring means, said brake wheel engages the ground and said braking surface engages the wheel.

2. A skateboard brake according to claim 1 wherein said interposed means includes a stop for limiting the movement of said second lever away from said first lever to limit the spacing between said brake wheel and said braking surface.

3. A skateboard brake according to claim 2 wherein additional spring means urges said second lever away from said first lever.

4. A skateboard brake according to claim 3 wherein adjusting means is provided cooperating with said additional spring means for adjusting the force of said additional spring means.

5. A skateboard brake according to claim 2 wherein said stop comprises an adjusting screw in threaded engagement with one of said levers for adjusting the spacing between said levers.

6. A skateboard brake according to claim 1 wherein said levers are swingable on a common pivot.

7. A skateboard brake according to claim 6 wherein said common pivot is swingably mounted for swinging about a horizontal axis extending longitudinally of said body.

8. A skateboard brake according to claim 1 wherein said levers extend rearwardly of the trailing end of said body.

9. A skateboard brake according to claim 1 wherein said ground wheels are on two trucks supporting said body, and said brake is interposed between said trucks.

* * * * *